United States Patent [19]

Ippolito

[11] 4,428,270

[45] Jan. 31, 1984

[54] ELECTRONIC VIBRATO OR CELESTE

[75] Inventor: Anthony C. Ippolito, De Kalb, Ill.

[73] Assignee: The Wurlitzer Company, De Kalb, Ill.

[21] Appl. No.: 321,733

[22] Filed: Nov. 16, 1981

[51] Int. Cl.[3] ..... G10H 1/043

[52] U.S. Cl. ..... 84/1.24; 84/1.25; 84/DIG. 4; 381/62

[58] Field of Search ..... 84/1.24, 1.25, 1.26, 84/DIG. 4, DIG. 26; 179/1 J; 307/261, 555, 559, 561; 328/31, 32, 54, 168, 169, 171; 333/138, 165, 167

[56] References Cited

U.S. PATENT DOCUMENTS

| | | | |
|---|---|---|---|
| 2,382,413 | 8/1945 | Hanert | 179/1 |
| 2,905,040 | 9/1959 | Hanert | 84/1.24 |
| 3,241,069 | 3/1966 | Garfield | 328/171 X |
| 3,303,425 | 2/1967 | Pendleton | 328/171 X |
| 3,530,225 | 9/1970 | Gschwandter | 84/1.26 X |
| 3,546,490 | 10/1970 | Sangster | 307/293 |
| 3,681,531 | 8/1972 | Burkhard et al. | 179/1 J |
| 3,749,837 | 7/1973 | Doughty | 179/1 J |
| 3,833,752 | 9/1974 | van der Kooij | 84/1.24 |
| 3,866,505 | 2/1975 | Adachi | 84/1.24 |
| 4,000,676 | 1/1977 | Love | 84/1.25 |
| 4,038,898 | 8/1977 | Kniepkamp et al. | 84/1.24 |
| 4,164,884 | 8/1979 | Kakehashi | 84/1.24 |
| 4,205,579 | 6/1980 | Kakehashi | 84/1.24 |
| 4,244,262 | 1/1981 | Imai | 84/1.24 |
| 4,304,162 | 12/1981 | Schreier | 84/1.25 |
| 4,354,415 | 10/1982 | Sonnabend | 84/1.24 |

*Primary Examiner*—S. J. Witkowski

*Attorney, Agent, or Firm*—Trexler, Bushnell & Wolters, Ltd.

[57] ABSTRACT

Electronic circuits are provided for producing an electronic timbre modulation for effecting celeste or vibrato similar in sonic results to the well-known Leslie rotating speaker system. Electronic signals corresponding to audio tones are generated and are modified by appropriate filters. Three controlling oscillators are locked in exactly 120° phase relation to one another and act through three voltage controlled oscillators respectively to modulate three bucket brigade circuits through which said modified electronic signals are passed substantially in parallel. A roving band pass filter further modulates those of said electronic signals corresponding to flute tones to simulate other aspects of a Leslie speaker system.

23 Claims, 11 Drawing Figures

ELECTRONIC VIBRATO OR CELESTE

BACKGROUND OF THE INVENTION

The Leslie sound systems are well known in the patent and commercial arts, and little need be said about them here. In general, either a horn is provided in front of a fixed loudspeaker, which horn rotates, or speakers themselves are rotated. This is acknowledged to produce generally a Doppler effect. In somewhat simplified analysis of a Leslie system, there will be heard the base frequency, and two additional frequencies, one being the nominal audio base frequency plus the frequency of the rotating system from the speaker approaching the listener, and a third frequency containing the audio base frequency minus the speed determined by the rotating system speaker moving away from the listener. This will provide three fixed frequencies.

There are disadvantages to the Leslie system introduced by the mechanical moving parts. A certain amount of noise always is to be expected from moving parts, there is a significant bulk which limits portability, the size of rotating parts is limited, and an organist cannot listen to such a system with earphones, nor can recordings be made thereof other than by way of a microphone. Leslie systems also always require separate, additional amplifiers, swell control potentiometers, and wood or plastic envelopes to prevent other sounds in the organ from being modulated by the rotating assembly. Strictly electronic efforts have been made to produce vibrato or celeste with varying degrees of success. One such system shown in the patent art in van der Kooij U.S. Pat. No. 3,883,752 and in Adachi U.S. Pat. No. 3,866,505 has achieved some degree of commercial success. In this system the audio tones from an organ are passed through three analog shift registers or bucket brigade delay devices. The three delay lines are respectively modulated by signals which are supposed to be 120° out of phase with one another. However, the phase shifting is achieved by phase shifting networks, and as will be appreciated such networks can produce the exact degree of phase shifting required at only one given frequency. At all other frequencies the amount of phase shift will differ quite considerably, depending on frequency. Similar results have been achieved by the Wurlitzer Symphonic Presence Modulator incorporated in various contemporary Wurlitzer organs. A further such effort is made in Love U.S. Pat. No. 4,000,676, utilizing only two analog shift registers, and again relying on frequency shifting networks. Somewhat similar efforts are also made with use of either analog shift registers, or digital shift registers with analog-to-digital and digital-to-analog converters in Doughty U.S. Pat. No. 3,749,837. Older patent art of some relevance, but utilizing older artificial delay lines rather than shift registers includes Hanert U.S. Pat. No. 2,382,413 and Hanert U.S. Pat. No. 2,905,040.

OBJECTS AND BRIEF SUMMARY OF THE PRESENT INVENTION

It is an object of the present invention to provide, in an electronic organ, means for producing a celeste or vibrato effect producing only desired audio frequencies plus sum and difference frequencies in accordance with an audio modulating frequency.

Most specifically, it is an object of the present invention to provide three substantially parallel bucket brigade devices in an electronic organ which are modulated to produce a celeste or vibrato effect, wherein the modulating frequencies are exactly 120° out of phase with one another.

Another object of the present invention is to provide, in an electronic organ, a plurality of bucket brigade delay devices transmitting the audio frequencies, and modulated to produce celeste or vibrato, wherein each bucket brigade device is driven by an amount to produce an equal percentage of frequency deviation from each bucket brigade device.

Another object of the present invention is to provide electronic circuitry in an electronic organ which electronically produces substantially the same effect as the electromechanical Leslie system, and which can be listened to with earphones, or recorded directly without the necessity of an intervening microphone.

In achieving the foregoing and other objects and advantages three phases of modulating frequencies for three bucket brigade delay devices are provided with the three phases exactly at 0°, 120°, and 240°. This is effected by the use of three phase shift voltage controlled oscillators (VCOs) in which each oscillator controls the succeeding oscillator to ensure the desired phase relationship without the use of phase shifting networks. The outputs of the VCOs are in the form of triangular waves which are respectively applied to limiters to provide trapezoidal, flat top waves. These in turn control three further voltage controlled oscillators which operate as modulated clocks to modulate the three bucket brigade delay devices, the latter being substantially in parallel in carrying the audio signal.

THE DRAWINGS

Other and further objects and advantages of the present invention will become apparent from the following specification when taken in connection with the accompanying drawings wherein.

DETAILED DESCRIPTION OF THE ILLUSTRATED EMBODIMENT

Figure 1:
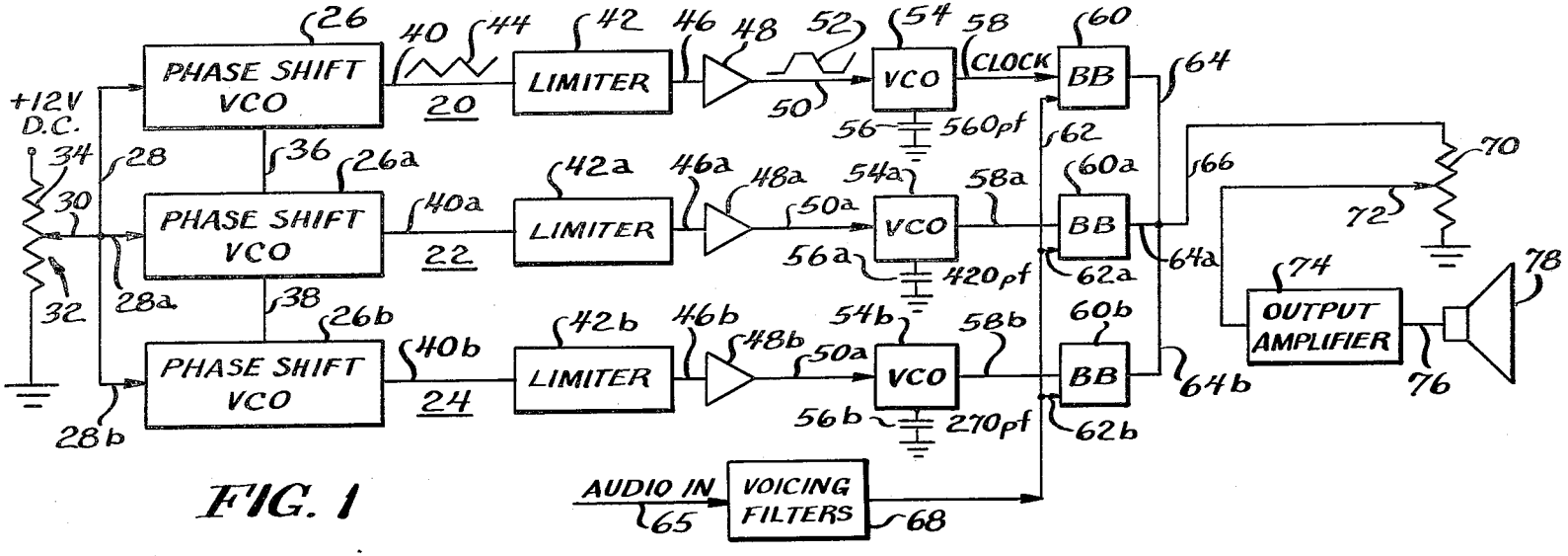
FIG. 1 is an electrical block diagram illustrating the principles of the present invention.

Attention is first directed to the block diagram of the present invention appearing in FIG. 1. There are three modulating channels 20, 22, and 24. Each channel comprises basically identical components, and to avoid unnecessary repetition the upper channel 20 will be described, while numerals similar to those in channel 20 will be applied to channel 22 with the addition of the suffix a as to channel 22, and with the suffix b in channel 24. Thus, the channel 20 includes a phase shift VCO (voltage controlled oscillator) having an input line 28 from the tap 30 of a potentiometer 32 including a resistor 34 having 12 volts D.C. applied at the top end, and grounded at the bottom end. This direct current potential determines the frequency of the phase shift VCOs.

There is an interconnection shown at 36 to VCO 26 to VCO 26*a*, and there is a similar connection 38 from VCO 26*a* to VCO 26*b*. The VCO 26 has an output line 40 leading to a limiter 42. The waveform 44 carried on the output line 40 is a triangular wave 44 as indicated above the line 40.

The limiter 42 clips the peaks off the triangular wave as will be discussed hereinafter in greater detail, the output of the limiter being connected by a line 46 to an amplifier 48. The output from the amplifier is carried on a line 50, and is shown as a flat top or clipped triangular wave 52. The line 50 leads to a VCO 54 having a shunting capacitor 56. The capacitors of the three different VCOs 54, 54*a*, and 54*b* are of different size as will appear later, the capacitor 56 being 560 picofarads. The capacitor 56*a* is 420 picofarads and the capacitor 56*b* is 270 picofarads. The output of the VCO 54 comprises a variable clock output 58, and leads to the clock input of an analog shift register or bucket brigade device 60. Each bucket brigade device 60 also has an input 62 from an Audio In line 65 through various voicing filters 68. The audio frequency on the Audio In line 65 comprises electronic oscillations corresponding to the musical audio frequencies of the organ, and can be all of the audio frequencies, or all of the audio frequencies of a particular manual. The outputs 64, 64*a*, and 64*b* from the bucket brigade devices are combined at 66 and lead to a potentiometer 70, the tap 72 of which leads to the input of an output amplifier 74, connected at 76 to a loudspeaker 78. Provision may also be made for an input jack in the line 76 whereby the organist can listen with earphones with the loudspeaker 78 cut out. The loudspeaker is shown as exemplary, and it will be understood that there could be a plurality of loudspeakers as is well known in the art. The potentiometer 70 comprises the usual swell control of an electronic organ, and commonly is operated by a foot pedal.

Figure 2:
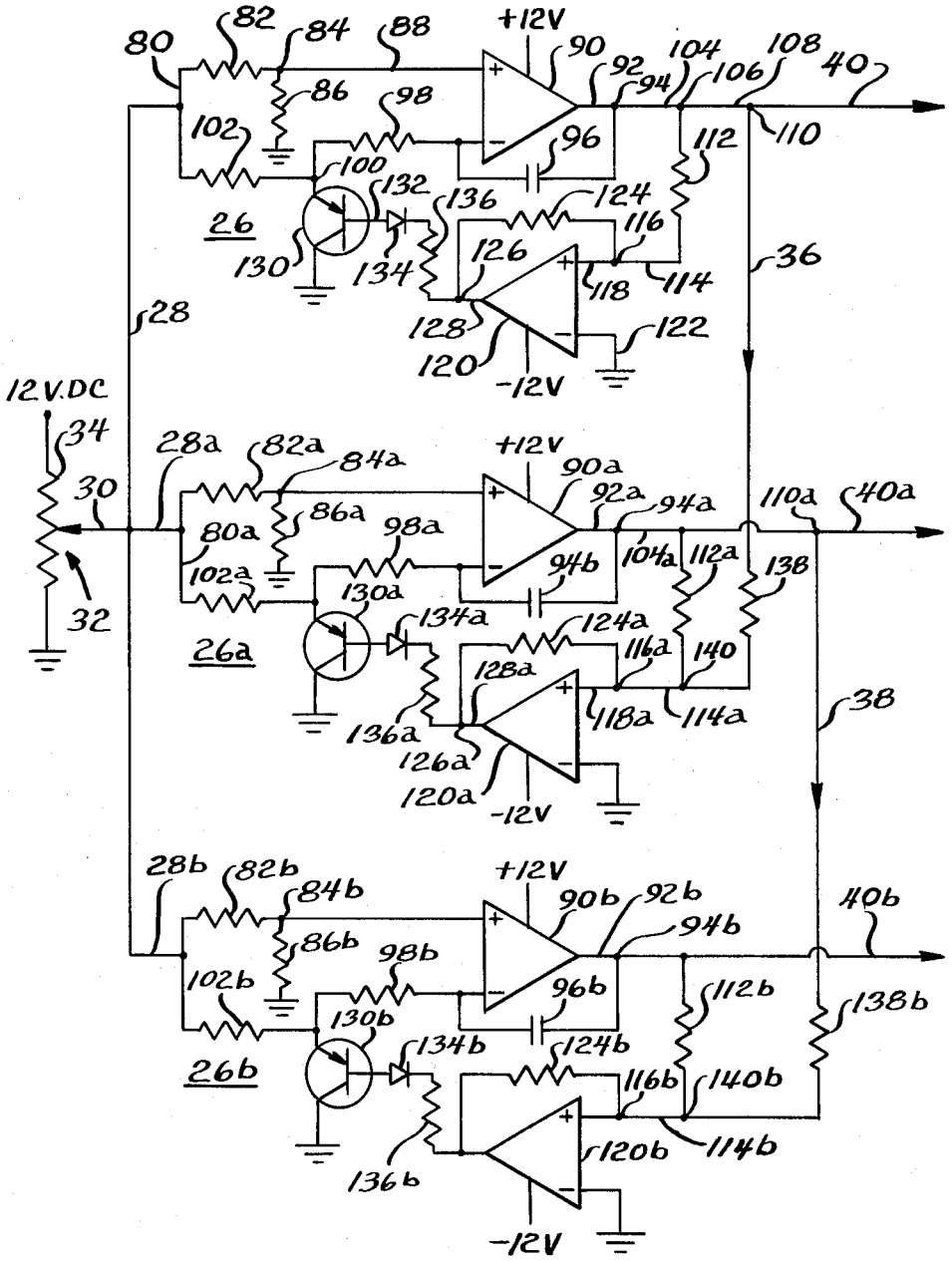
FIG. 2 is an electrical wiring diagram showing the circuit arrangement for providing three modulating frequencies exactly 120° out of phase with one another.

The three voltage controlled oscillators 26, 26*a* and 26*b* are shown in greater detail in FIG. 2. Since each of these three oscillators is of the same design only the oscillator 26 will be discussed in detail, oscillators 26*a* and 26*b* having similar parts identified by similar numerals with the respective additions of a and b. Thus, the input line 28 to the VCO 26 is connected to a line 80 which at one end is connected to a resistor 82 leading to a junction 84. The junction is shunted to ground by a resistor 86. The junction further is connected by a conductor 88 to the positive terminal of an operational amplifier 90. The output of the operational amplifier is connected to a line 92 leading to a junction 94. The junction 94 is connected to the negative input of the operational amplifier 90 by a capacitor 96. The negative input also is connected through a resistor 98 to a junction 100, the latter being connected to the line 80 by a resistor 102. The junction 94 is connected by a conductor 104 to a junction 106, and to a line 108 which leads to a junction 110 and the output line 40. The junction 106 is connected by a resistor 112 and a conductor 114 to a junction 116. This junction is connected by a conductor 118 to the positive input of an operational amplifier 120. The negative input terminal of this operational amplifier is connected to ground at 122. The junction 116 is connected by a resistor 124 to a junction 126 on the output line 128 from the operational amplifier 120.

The previously mentioned junction 100 is connected to the emitter of a PNP transistor 130, the collector of which is grounded. The base is connected through a conductor 132 to the anode of a diode 134, the cathode of which is connected through a resistor 136 leading to the junction 126. This circuit and the operation thereof are well-known in the art, and need not be repeated at this point. Suffice it to say that a triangular waveshape is produced on the output line 40.

What is novel about the circuit shown in FIG. 2 is that there are three such operational amplifiers in close proximity. The junction 110 of the VCO 26 is connected by the line 36 to a resistor 138 leading to a junction 140 between the resistor 112*a* and the line 114*a*, whereby connection is made between the output line 40 of the VCO 26 and the junction 116*a* leading through conductor 118*a* to the positive input of the operational amplifier 120*a*. Similarly, the line 38 leads from the junction 110*a* on the output line 40*a* to a resistor 138*b* leading to junction 140*b* between resistor 112*b* and conductor 114*b*.

Each of the three VCOs 26, 26*a* and 26*b* should operate at the same frequency due to the same applied voltage from the tap 30 on the potentiometer 32. However, the connection of the line 36 holds the second oscillator 26*a* from oscillation until the first oscillator output potential has reached two-thirds of its maximum swing. At this time the potential supplied by the line 36 starts the oscillator 26*a* in operation. Similarly, when the level on the output line 40*a* has reached two-thirds of the maximum output of the triangular wave appearing thereon the connection through the line 38 starts VCO 26*b* into operation. Thus, considering the output wave of the oscillator 26 as being at 0°, the wave of the oscillator 26*a* is at 120°, and the output wave of the oscillator 26*b* is at 240°. This is an exact relationship and is true at all frequencies, unlike the phase splitting or shifting that is accomplished by means of filters.

Figure 3:
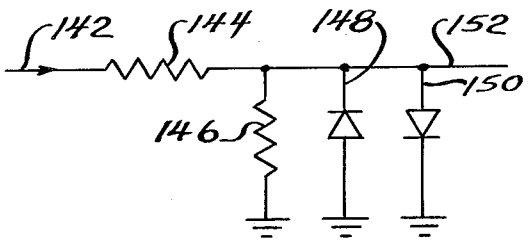
FIG. 3 PRIOR ART
FIG. 3 is an electrical wiring diagram of a prior art voltage limiter or clipper.

A prior art form of clipper is shown in FIG. 3, and includes an input line 142 leading to a resistor 144 which is shunted to ground by a resistor 146. The line further is shunted to ground by back-to-back diodes 148 and 150, leading to an output line 152. Whenever the signal appearing at the top ends of the diodes exceeds the voltage at which the diodes become conductive the peak will be clipped off. This scheme heretofore has been used for approximating a sine wave from a triangular wave. However, due to the conductive characteristics of diodes which do not provide an instant on-off the wave is not clipped off flat, but rather on a rounded pattern. This is fine for producing sine waves; it does not produce acceptably flat cut off portions as required in the present invention as shown by the wave 52 in FIG. 1.

Figure 9:
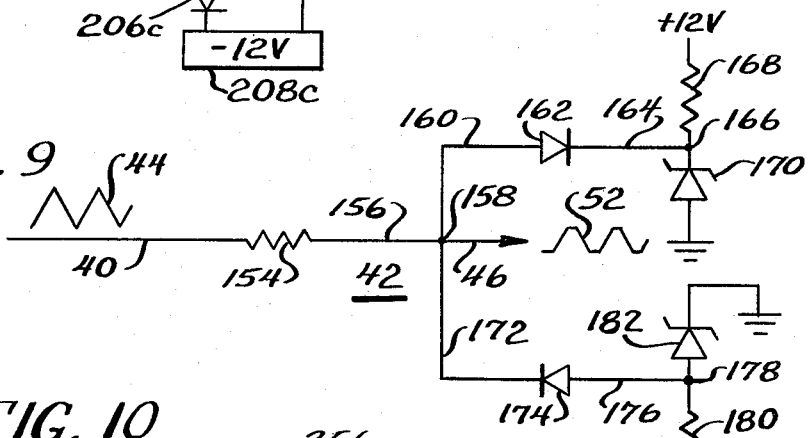
FIG. 9 is an electrical wiring diagram illustrating a waveshaping circuit used in the present invention.

A preferred limiter in accordance with the present invention is shown in FIG. 9, wherein the triangular waveshape 44 is again shown above the line 40. The limiter 42 comprises an input resistor 154 connected to the line 40. From the resistor a conductor 156 leads to a junction 158, having the output line or conductor 46 connected thereto. The junction also leads through a conductor 160 to the anode of diode 162 having the cathode connected to a conductor 164 leading to a junction 166. The junction 166 is connected through a resistor 168 to a positive 12-volt source. The junction 166 also is connected to the cathode of a zener diode 170, the anode of which is connected to ground. The junction 158 further is connected to a conductor 172 which leads to the cathode of a diode 174. The anode is connected to a further conductor 176 leading to a junction 178. The junction 178 is connected through a resistor 180 to a negative 12 volts. The conductor also is connected to the anode of a zener diode 182, the cathode of which is grounded.

With the circuitry as shown and described and with the choice of proper resistance values the peak one-third in both positive and negative directions of the wave 44 are cut off to leave the flat top waves 52 on output line 146.

Figure 4:
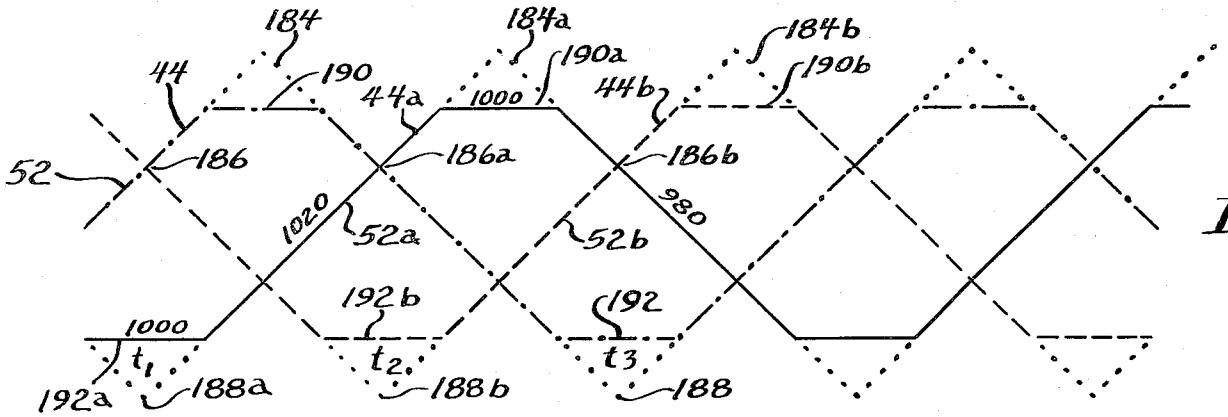
FIG. 4 is a multiple wave diagram illustrating certain principles of the present invention.

Operation of the phase shift VCOs 26, etc., and of the limiter 42, etc., will better be understood with reference to the waveshape diagram of FIG. 4. Thus, the output of the VCO 26 is shown in dot-dash lines 44, the peaks thereof being shown in phantom at 184 since they are subsequently removed. When the positive slope of the wave 44 reaches point 186 which is two-thirds of its full value, it triggers operation of the VCO **26*a* to produce the output wave 44*a*, the peak thereof also being shown in phantom at 184*a*. The wave 44*a* starts upward at point 188*a*, exactly 120° after the wave 44 started upward. Similarly, when the wave 44*a* reaches point 186*a* at two-thirds of its maximum height it triggers VCO 26*b* so that the wave 44*b* starts upward at point 188*b*. When the upward slope of wave 44*b* reaches 186*b* at two-thirds of its maximum amplitude VCO 26 again starts a cycle for its output wave 44*a* to start rising at point 188*b***.

Thus, the waves are at successive 120° phase relationship with one another. The triangular waves after passing through the limiter have the peaks 184, **184*a*, 184*b* and 188, 188*a* and 188*b* are clipped, thus producing flat tops 190, 190*a* and 190*b*, and similar flat bottoms 192, 192*a* and 192*b*. The level at which clipping takes place in the limiter is chosen so that each flat top 190 is of the same horizontal dimension as the time space between successive flat tops, such as 190 and 190*a***. Similar spacing is ensured at the bottom portions of the waves.

It will be recalled that each of the three limited waves 52, **52*a*, 52*b* is utilized to drive one of the VCOs 54, 54*a*, and 54*b*. An upward slope on one of the waves 52** produces an output frequency from the corresponding VCO that is uniformly increasing in frequency. The flat top and bottoms of the waves do not change the VCO frequency at all during the time frequencies that the flat portions exist. On the down slope of each wave the VCO driven thereby produces a uniformly decreasing frequency.

It must be understood that when the clock frequency of a bucket brigade device is changing at a uniform rate the pitch of the audio signal going through the bucket brigade is not changing at all. The pitch change only occurs at the instant that one of the clock frequencies changes from a steady or fixed frequency to a changing frequency, and vice versa. The amount of pitch change is directly proportional to the slope of the sides of the waveforms driving the VCOs. During any increment of time the outputs of the three bucket brigade devices will contain: (1) the original incoming audio signal, (2) an audio signal raised slightly higher than the original, and (3) an audio signal the pitch of which is slightly lower than the original audio signal. Stated otherwise, there are three frequencies $f, \Delta f+f$, and $f-\Delta f$. Thus, the output from any one of the three bucket brigades will contain only one frequency of the three noted above during any given time interval. This neglects a pitch change that occurs at the instant the bucket brigade clocks are changing from a fixed frequency to a changing frequency, and vice versa. This is why it is necessary to utilize the zener diode circuit of FIG. 9 to produce sharply clipped triangular waves instead of the conventional diode limiters, thus maintaining the transient time at a minimum.

As a specific example for ready understanding, whole numbers are chosen which do not necessarily agree with any particular musical pitch. Thus, with continued reference to FIG. 4 if we assume 1,000 Hz during the time interval $t_1$ the output of the bucket brigade driven by the VCO clock frequency corresponding to waveform **52*a* will contain only the 1,000 Hz incoming audio signal. During this same time period the bucket brigade device driven by VCO 54 will produce an output frequency of $1{,}000+\Delta f$. If 2% modulation is chosen as exemplary, then the output frequency will be 1,020 Hz. During this same time period $t_1$ the output frequency corresponding to wave 52*b* will be 90 Hz. During time period $t_2$ the output of the bucket brigade controlled by the wave 52*b* will be 1,000 Hz, the output of the bucket brigade driven by the wave 52*a* will be 1,020 Hz, and the output of the bucket brigade driven by the wave 52** will be 980 Hz. A similar analysis can be made for the time period $t_3$. The important thing is that in any given time increment there will be the input audio frequency at the output, here assumed to be 1,000 Hz, plus the modulated frequencies, here exemplified as 1,020 Hz and 980 Hz.

The output audio signals from the loudspeaker closely simulate a three-frequency celeste. if the corners where the triangular waves are clipped to flat tops could be of infinitely small time duration there would be a very smooth celeste. However, there is a very short transient time, and this causes the output to assume some vibrato or tremolo characteristics.

Figure 7:
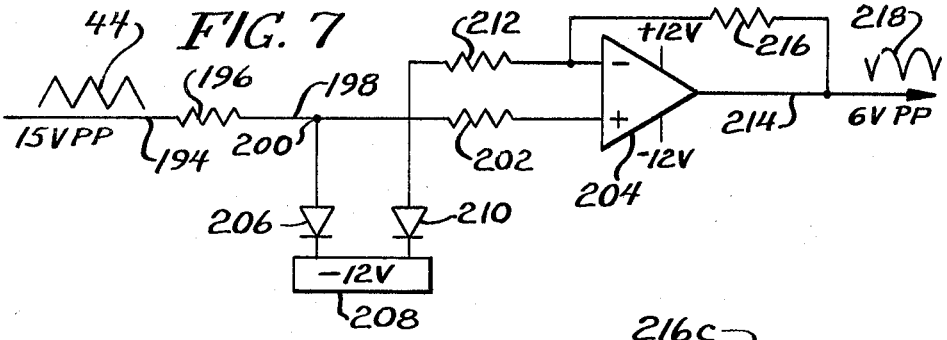
FIG. 7 is an electrical wiring diagram forming a part of the circuit of the present invention for incorporating a logarithmic amplifier.

The VCOs 54, **54*a* and 54*b* that are utilized in the present circuits to drive the bucket brigade clocks are not linear. Accordingly, it is preferred to use a logarithmic amplifier as shown in the circuit of FIG. 7. A triangular input wave 44 is shown having a potential of 15 volts peak-to-peak on a conductor 194 leading to a resistor 196. A line 198 from the resistor 196 leads to a junction 200, and on through a resistor 202 to the + input of a differential or operational amplifier 204. The amplifier is a type 324. The junction 202 also leads to the anode of a diode 206, the cathode of which is connected to a −12-volt supply 208. The cathode of another diode 210 is also connected to the −12-volt supply 208, and the anode thereof leads through a resistor 212 to the negative input of the amplifier 204. The output line 214 from the amplifier 204 is fed back through a resistor 216 to the negative input of this amplifier. The output waveform is shown at 218** and has a peak-to-peak amplitude of 6 volts.

Figure 8:
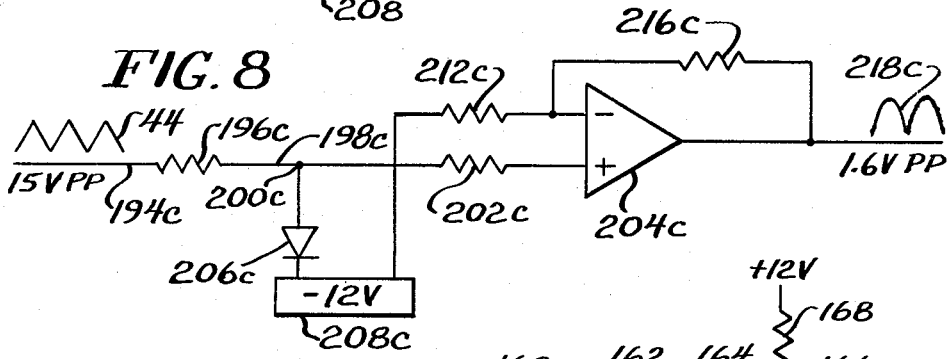
FIG. 8 is a wiring diagram comprising a modification of FIG. 7.

A modification of the circuit of FIG. 7 is shown in FIG. 8 for producing a 1.6-volt peak-to-peak output voltage. To avoid repetition and prolixity where parts are the same or substantially the same they are numbered with the same numbers as used in FIG. 7, but with the addition of the suffix c. Differences reside in resistor values chosen, and in elimination of the diode 210. The negative input terminal of the amplifier 204 is connected through the resistor 212c directly to the −12-volt source, rather than through a diode. Also, the plus and minus 12-volt inputs shown with regard to the amplifier 204 are omitted from the amplifier 204c. As to specific resistor values, the resistor 216 comprises 820K ohms, while the resistor 216c is 470K ohms. The resistor 212 is 6.8K ohms, while the resistor 212c is 18K ohms. The resistor 202 is 10 K ohms, while the resistor 202c is 33K ohms.

Somewhat different effects can be produced by operating the phase shift VCOs 26 at different speeds. When operated at 6 or 7 Hz the effect is more that of vibrato, while when operated at 1 Hz or below it is more a presence effect. Means for effecting such a change are contained in a circuit illustrated in FIG. 5. A positive 12-volts is applied to a bus line 220 connected to the movable arm 222 of an on-off switch 224. The fixed poles of this switch comprise an off pole or contact 226, and an on pole or contact 228, alternatively engageable by the switch arm 222. The fixed contact 228 is connected through a conductor 230 to a junction 232. From this junction a resistor 234 leads to a junction 236. Th junction 236 is shunted to ground by a capacitor 238. It further is connected to a conductor 240 leading to junction 242. This junction is connected to the positive input of a type 324 amplifier 244. The output of this amplifier is applied to a conductor 246, and there is a feedback line 248 leading from the conductor 246 to the negative input of the amplifier 244.

The previously mentioned 12-volt bus 220 is connected to a speed switch 250 having a movable contact 252 movable between a slow, fixed switch contact 254, and a fast, fixed switch contact 256. The movable arm 252 is connected to a conductor 258 leading to a resistor 260, the other end of which is connected to a junction 262. The junction is shunted to ground by a resistor 264. The junction is also connected by a conductor 266 to the base of an NPN transistor 268. The emitter of this transistor is grounded, while the collector is connected to a junction 270. A resistor 272 connects the junction 270 with the previously mentioned junction 244. A conductor 274 is connected to the junction 270, and leads to a junction 276 between a grounded resistor 278, and a resistor 280 connected by a conductor 282 to the previously mentioned junction 232.

With the switch 224 in the off position there is no positive voltage applied to the amplifier 244, whereby a zero voltage appears on the output line 246. However, when the switch 224 is moved to the on position a positive potential somewhat less than 12 volts is applied to the positive input of the amplifier 244.

If the fast-slow switch 250 is set to the fast position as shown, then there will be no voltage appearing on the conductor 258, and the transistor 260 will be essentially an open circuit to ground, and the amplifier 244 will provide a relatively high voltage on the output conductor 246. On the other hand, if the fast-slow switch 250 is moved to the slow position, 12 volts positive potential will appear on the conductor 258, and the transistor 268 will be biased to conduction. This will essentially place the junction point 242 at an intermediate position between 12 volts and ground due to voltage divider action of the resistors 234 and 272, and a lesser potential will be applied to the positive input terminal of the amplifier 244, thus producing a lower D.C. potential on the output conductor 246. In accordance with the present modification of the invention the output conductor 246 substitutes for the conductor 30 in FIG. 1, whereby the positive potential applied to the three phase shift VCOs 26, 26a and 26b is at either one of two discrete voltages, rather than at a continuously adjustable voltage. As a result, the three VCOs 26, 26a, and 26b will all oscillate at a relatively fast repetition rate, or at a relatively slow repetition rate. This will result in the three VCO clocks 54, 54a, and 54b running at one of two discrete speeds, rather than at the variable speeds established by the potentiometer 32 in FIG. 1.

Figure 6:
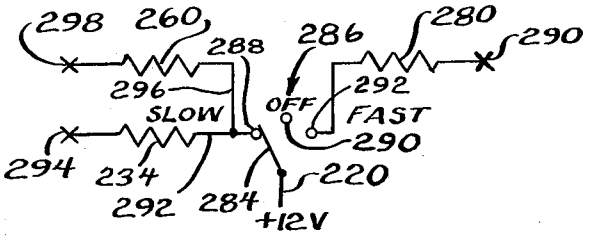
FIG. 6 is an electrical wiring diagram illustrating a modification of a part of FIG. 5.
Figure 5:
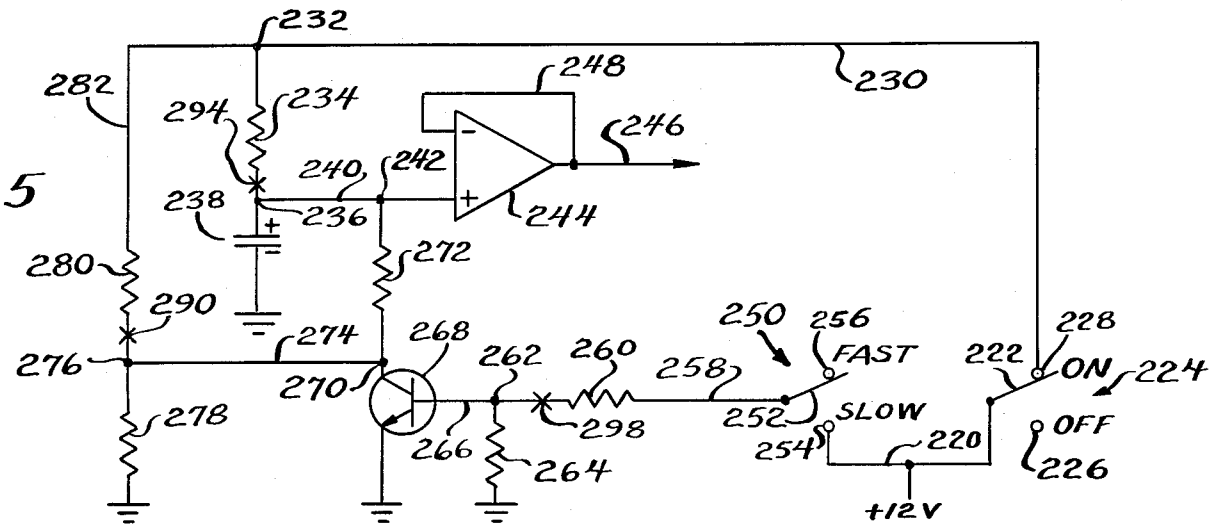
FIG. 5 is an electrical circuit diagram showing an arrangement for selecting either of two desired modulating frequencies.

A modification of the circuit of FIG. 5 is shown in FIG. 6 allowing operation with a single switch rather than the two switches shown in FIG. 5. In FIG. 6 the 12-volt bus line 220 is connected to the movable arm 284 of a switch 286 having a slow fixed contact 288, an off contact 290, and a fast contact 292. The fast switch contact 292 is connected to the resistor 280. Line breaking point "X", identified by numeral 290 in both FIGS. 5 and 6 indicates where FIG. 6, in part, would connect into FIG. 5. The slow fixed contact 288 is connected by a conductor 292 to the resistor 234, and line break "X" 294 indicates a common location in FIGS. 5 and 6. A branch 296 from line 292 extends to the resistor 260, while line break "X" indicated at 298 indicates common location in FIGS. 5 and 6. As will be appreciated, when the circuit of FIG. 6 is incorporated into FIG. 5, the two switches 224 and 250 are completely eliminated. It is not necessary to remove and replace the resistors 234, 260, and 280, but the same resistors are shown in both FIGS. 5 and 6 to permit ready perception of the incorporation of FIG. 6 into FIG. 5.

With the movable switch arm 284 on the off fixed contact 290, it is apparent that the circuit of FIG. 5 will not function to do anything. When it is moved to the fast fixed contact 292, then potential will be conducted through the resistor 280 to junction 276, conductor 274, junction 270, resistor 272, and junction 242 to apply a positive potential to the plus input of the amplifier 244 to provide a D.C. output on conductor 246, and thus to produce relatively rapid oscillation from the phase shift VCOs. On the other hand, with the movable contact 284 moved to the slow contact 288, voltage will be applied at a lower potential to the positive input of the amplifier 244, through a voltage divider comprising resistor 234 and resistor 272, potential through the resistor 272 turning on the transistor 268 to provide substantially a short circuit at that point. Thus, a lower potential is applied to the positive input connection, and a lower output voltage appears on conductor 246, whereby the phase shift VCOs will operate at a slower rate.

Figure 10:
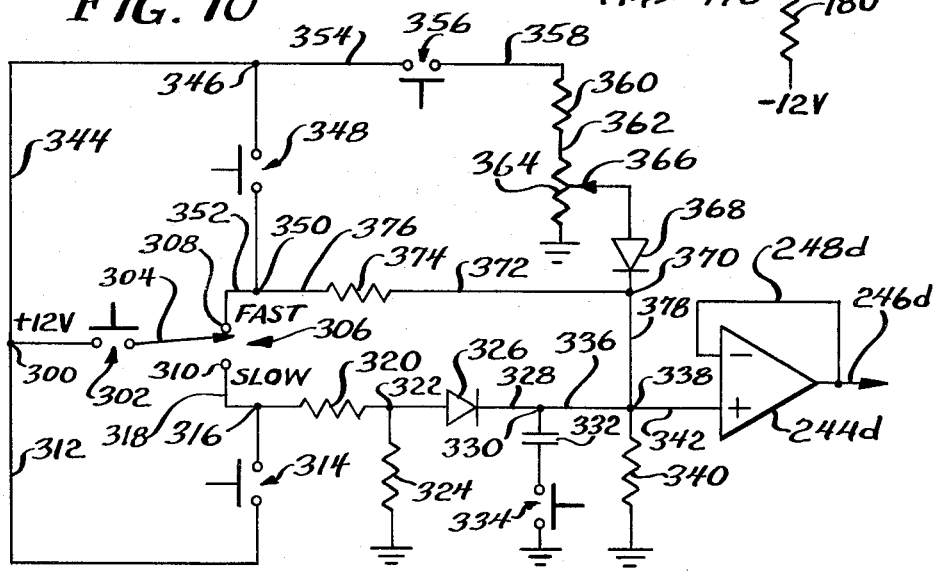
FIG. 10 is an improved alternative to the wiring diagram of FIG. 5.

An improved form of switching circuit to incorporate the advantage of two-speed electronic vibrato or celeste is shown in FIG. 10. The output amplifier 244d and the connections to the output at 246d and the feedback connector at 248d are the same in FIG. 10 as the correspondingly numbered parts in FIG. 5. In this Figure a positive 12-volt potential is applied to a junction point 300 which leads to a normally open shorting bar-type of switch 302, the opposite side of which is connected to the movable arm 304 of a switch 306 having a fast fixed contact 308 and a slow fixed contact 310, the two fixed contacts being alternatively engageable by the arm 304.

The 12-volt junction 300 also is applied to a conductor 312 leading to another shorting bar-type switch 314, the other side of which is connected to a junction 316. The junction 316 is connected by a conductor 318 to previously mentioned junction 310. Junction 316 also is connected to a resistor 320 which leads to a junction 322. The junction 322 is shunted to ground by a resistor 324, and also is connected to the anode of a diode 326. The cathode of this diode is connected by a conductor 328 to a junction 330. This junction is connected through a capacitor 332 to another shorting bar switch 334, the opposite side of which is connected to ground. The junction 330 further is connected by a conductor 336 to a junction 338. This junction is shunted to ground by a resistor 340, and also is connected by a conductor 342 to the positive input of the amplifier 244*d*.

The positive 12-volt junction 300 also is connected to a conductor 344 which leads to a junction 346. This junction is connected by another shorting bar switch 348 to a junction 350 which is connected by a conductor 352 to the fast contact 308 of switch 306.

The junction 346 further is connected by a conductor 354 to a shorting bar switch 356, the other side of which is connected by a conductor 358 to a resistor 360. The resistor 360 is connected at 362 to a potentiometer resistor 364, the opposite end of which is grounded. The tap 366 of the potentiometer 364 is connected to the anode of a diode 368. The cathode of this diode is connected a junction 370 which is connected to a conductor 372 leading to a resistor 374 which is in turn connected by a conductor 376 to the junction 350. The junction 370 also is connected by a conductor 378 to the junction 338.

In changing speed in a mechanical Leslie device there is necessarily a time delay. This is inherently undesirable, but organists are used to it, and it therefore is sometimes wanted, even though it is not musically useful. The circuit of FIG. 10 produces such a time delay. The potentiometer tap 366 is located in a convenient key block to permit infinite tremolo rate settings with no time delay. It is also possible with programmable registration (see W. R. Hoskinson et al U.S. patent application Ser. No. 190,215, filed Sept. 24, 1980, and now U.S. Pat. No. 4,388,851, assigned like this application to The Wurlitzer Company, DeKalb, Ill.) for producing the desired celeste or vibrato rate with no time delay. The FAST/SLOW switch 306 has an intermediate inactive position, and all of the switches conveniently are incorporated in two quad bilateral FET packages. In the circuit of FIG. 10 switches 302 and 334 are closed when the FAST/SLOW mode is active, that is when the switch 306 is on either the fast fixed contact 308, or the slow fixed contact 310, is controlled by a stop tablet on the organ. When the movable switch contact 304 is midway between the FAST and SLOW fixed contacts, and switch 356 is closed, potential to the amplifier 244*d* is manually determined by positioning of the tap 366 on the potentiometer resistor 364. As will be apparent, this allows a continuous progression within the limits of the circuit.

When the FAST/SLOW mode is active switches 302 and 334 are closed and potential is provided through closed switch 302 and either through contact 308, resistor 374, conductors 372, 378, and 342 to the positive input terminal of amplifier 244*d*, or through contact 310, resistor 320, diode 326, over shunting capacitor 332, and conductors 336 and 342 to the positive terminal. As will be seen, this gives one of two voltage levels to the positive terminal, thereby providing fast or slow speed. Capacitor 332 ensures delay in changeover when switch 306 is moved between FAST and SLOW.

Finally, with the use of the programmable registration circuit switch 314 or switch 348 is closed to determine the potential applied to the positive input terminal of the amplifier 244*d*. Switches 302, 334, and 356 are open circuited. Under this circumstance the capacitor 332 is not included in the circuit, so that the potential may switch instantly.

It will now be apparent that there has been disclosed an electronic celeste or vibrato effect variable between about ½ Hz and 7 or 8 Hz, or higher if desired, in which the final audio output includes the note being played, namely f, and also $f+\Delta f$ and $f-\Delta f$ with little or no perceptible changing frequency.

Figure 11:
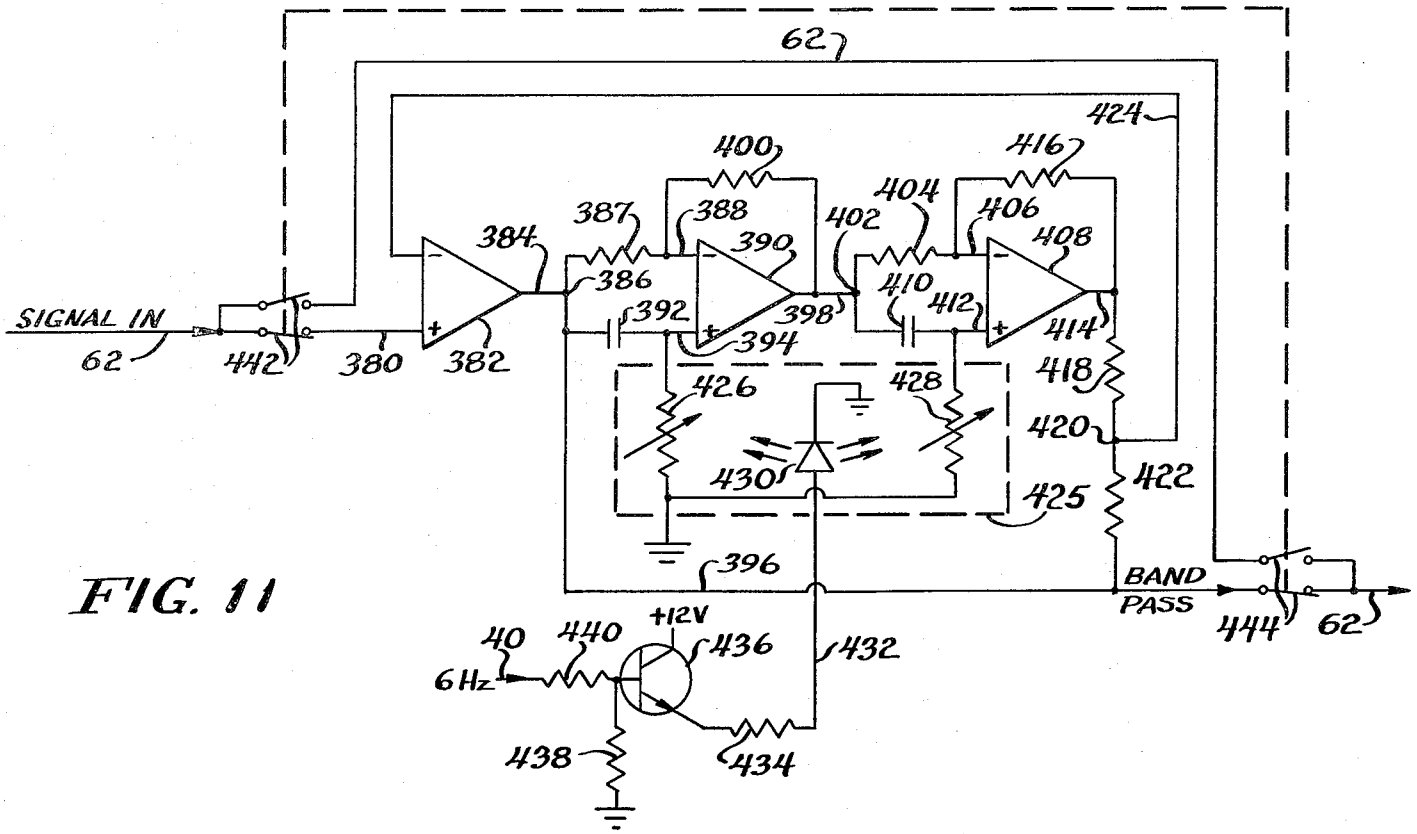
FIG. 11 is a circuit diagram of a roving band pass filter for achieving added effect.

There are various miscellaneous sound effects produced by Leslie speaker systems which may or may not be musically valid, but which musicians are used to. Depending on the shape and size of the enclosure in which the rotating speaker system is mounted, different frequencies will be emphasized at different times, such as when the speaker is approaching or receding from a corner of the enclosure. I have found that such effects can be simulated by inclusion of a roving band pass filter in the modulating circuit. Such a circuit is shown in FIG. 11.

A signal in line 380 leads to the positive input of an operational amplifier 382. The signal in line 380 would comprise the output of the flute filters among the voicing filters 68, and in this connection it will be understood that the line 62 in FIG. 1 comprises one lead from the flute filters, and one lead from the other filters, i.e., the complex filters. The output line 384 from the operational amplifier 382 (each operational amplifier in FIG. 11 will hereinafter be identified by the common electronics abbreviation of "op amp") is connected to a junction 386. The junction leads through a resistor 387 to the negative input 388 of an op amp 390. The junction 386 is also connected through a capacitor 392 to the positive input 394 of the op amp 390. A line 396 leads from the junction 386 and comprises a band pass output line, connected back into the flute filter conductor of the line 62 leading to the bucket brigade devices.

The output 398 of the op amp 390 is connected back through a resistor 400 to the negative input 388, and is also connected to a junction 402. The junction 402 is connected through a resistor 404 to the negative input 406 of an op amp 408. The junction 402 is connected through a capacitor 410 to the positive input 412 of the op amp 408.

The output 414 of the op amp 408 is connected back through a resistor 416 to the negative input 406, and is also connected to a resistor 418 leading to a junction 420 which is connected through a resistor 422 to the output line 396, and which also is connected through a feedback line 424 to the negative input of the op amp 382.

The circuit further includes a dual linear gate package 425 including a first LDR (light dependent resistor) 426 connected between the positive input 394 of the op amp and ground, a second LDR 428 connected between the positive input 412 of op amp 408, and an LED (light emitting diode) 430 emitting light on both LEDs. The cathode of the LED 430 is grounded while the anode is connected through a line 432 and a resistor 434 to the emitter of an NPN transistor 436. The collector of this transistor is connected to a +12 volt supply. The base is shunted to ground by a resistor 438 and is connected by a resistor 440 to a source of 6 Hz potential. Conveniently, this is the triangular wave 44 appearing on the output line 40 of the phase shift VCO 26.

The circuit provides a resonant peak varying at a 6 Hz rate from about 50 Hz to about 5.6 KHz. This range could be easily extended, but it is sufficient to cover the fundamental frequency range of most of the gamut of an electronic organ, and it is to be borne in mind that the flute tones are almost entirely fundamental with little or no overtones. The Q of the circuit is approximately equal to the ratio of resistor 418 to resistor 422 and preferably is chosen to be somewhat over 2 with exemplary values of 12K ohms and 5.6K ohms.

Accordingly, electronic oscillations corresponding to flute tones are emphasized at and adjacent the roving band pass frequencies at the same 6 Hz rate as the variation of the VCOs 54, 54*a*, and 54*b* to produce sonic results similar to a Leslie speaker system.

Preferably the roving band pass filter is switchable in and out of the circuit by means of ganged pairs of alternately open switches 442 and 444.

Various changes in the circuits as described herein will no doubt occur to those skilled in the art, and will be understood as forming a part of the present invention insofar as they fall within the spirit and scope of the appended claims.

The invention is claimed as follows:

1. Electronic circuit means for creating a vibrato or celeste effect in an electronic musical instrument having electric oscillations corresponding to musical tones comprising a plurality which is an integral multiple of three of like adjustable frequency oscillators all capable of oscillating at the same rate but different phase and each having an output, means for simultaneously adjusting said oscillators to a common rate, means to utilize the output of one of said oscillators to operate the next seriatim to maintain the phase of the latter constant relative to the former over a range of frequencies, a plurality of electronic delay means equal in number to said plurality of oscillators, means for applying said electric oscillations to said plurality of delay means, and means connecting said oscillators to said delay means to modulate said electric oscillations in said delay devices.

2. Electronic circuit means as set forth in claim 1 wherein there are three oscillators relatively at 0°, 120°, and 240° phase angles.

3. Electronic circuit means as set forth in claim 1 wherein each oscillator produces triangular waves, and means for truncating said triangular waves to produce flat topped triangular waves.

4. Electronic circuit means as set forth in claim 3 wherein the means for truncating the triangular waves includes 2 zener diodes.

5. Electronic circuit means as set forth in claim 1 wherein the means connecting the oscillators to the delay devices comprise voltage controlled oscillators.

6. Electronic circuit means as set forth in claim 5 and further including logarithmic amplifier means between said oscillators and said voltage controlled oscillators, said voltage controlled oscillators being non-linear and compensated for by said logarithmic amplifier means.

7. Electronic circuit means as set forth in claim 1 wherein said electronic delay means comprise bucket brigade devices.

8. Electronic circuit means as set forth in claim 1 wherein said oscillator rate adjusting means is continuously adjustable.

9. Electronic circuit means as set forth in claim 1 wherein said oscillator rate adjusting means causes said oscillators to operate at either of two predetermined rates.

10. Electronic circuit means as set forth in claim 1 and further including a variable band pass filter, means for connecting said filter in circuit with at least some of said electric oscillations, and means for varying the resonant frequency of said filter at the same rate as said oscillators.

11. Electronic circuit means as set forth in claim 10 wherein the means for varying the resonant frequency of said filter comprises an interconnection from one of said oscillators.

12. Electronic means for creating vibrato or celeste in an electronic musical instrument having electric oscillations corresponding to musical tones comprising three voltage controlled oscillators each generating triangular waves having equal ascending and descending slopes and capable of generating like frequencies, electric voltage means connected to said voltage controlled oscillators to cause said oscillators to generate the same rate, means interconnecting the first and second oscillators and the second and third oscillators so that said three oscillators oscillate at the same rate and at relative phases of 0°, 120°, and 240°, three limiting means to which said three oscillators are respectively connected to truncate said triangular waves to produce flat tops thereon, each flat top having a duration of substantially one third of a corresponding triangular wave half cycle, three voltage controlled oscillators to which said limiting means are respectively connected, three bucket brigade devices to which said electric oscillations are applied, and means connecting said last named voltage controlled oscillators respectively to modulate said electric oscillations in said bucket brigade devices.

13. Electronic circuit means for creating a vibrato or celeste effect in an electronic musical instrument having electric oscillations corresponding to musical tones comprising means for producing a plurality of triangular waves of equal magnitude and different phase and each having equal ascending and descending slopes, the phase difference being constant, means connected to said wave producing means to convert said waves to flat topped triangular waves, the flat top of each wave being of substantial duration relative to a half cycle of that wave, a like plurality of electronic delay means capable of modulation and to which said electric oscillations are fed, and means for applying said flat topped triangular waves to said delay means to modulate said electric oscillations.

14. Electronic circuit means as set forth in claim 13, wherein said wave applying means comprises a plurality of voltage controlled oscillators.

15. Electronic circuit means as set forth in claim 13 wherein said converting means comprises a plurality of zener diodes.

16. Electronic means as set forth in claim 13 wherein each electronic delay means comprises a bucket brigade device.

17. Electronic circuit means as set forth in claim 13 and further including variable band pass filter means, means for connecting said filter means in circuit with said electric oscillations, and means for varying the resonant frequency of said filter means including means interconnecting said wave producing means and said filter means.

18. Electronic circuit means for creating a vibrato or celeste effect in an electronic musical instrument having electric oscillations corresponding to musical tones comprising means for producing a plurality of flat topped triangular waves having reverse slopes of equal duration, the flat top of each wave being of substantial duration relative to a half cycle of that wave, a like plurality of electronic delay means capable of modulation and to which said electric oscillations are fed, and means connecting said wave producing means to said delay means to modulate the delay.

19. Electronic circuit means as set forth in claim 18 wherein each electronic delay means comprises a bucket brigade device.

20. Electronic circuit means as set forth in claim 18 and further including variable band pass filter means, means for connecting said filter means in circuit with said electric oscillations, and means for varying the resonant frequency of said filter means including means interconnecting said wave producing means and said filter means.

21. Electronic circuit means as set forth in claim 18 wherein the modulating connecting means comprises a like plurality of voltage controlled oscillators.

22. Electronic circuit means as set forth in claim 18 wherein said flat topped triangular waves are of equal frequency and bear predetermined phase angles to one another.

23. Electronic circuit means as set forth in claim 22 wherein there are three means for producing three flat topped triangular waves at relative phases of 0°, 120°, and 240°.

* * * * *